US005996447A

United States Patent [19]

Bayouth

[11] Patent Number: 5,996,447

[45] Date of Patent: Dec. 7, 1999

[54] SINK WRENCH

[76] Inventor: David Bayouth, 8420 Huntington St., Wichita, Kans. 67206

[21] Appl. No.: 08/986,920

[22] Filed: Dec. 8, 1997

[51] Int. Cl.[6] ..... B25B 13/48; B25B 13/06; B25B 13/00

[52] U.S. Cl. ..... 81/176.2; 81/121.1; 81/124.2

[58] Field of Search ..... 81/121.1, 124.2, 81/176.1, 176.15, 176.2

[56] References Cited

U.S. PATENT DOCUMENTS

| | | | |
|---|---|---|---|
| 949,711 | 2/1910 | McLane | 81/124.2 |
| 2,909,090 | 10/1959 | Moore | 81/176.15 |
| 3,086,414 | 4/1963 | Nardi | 81/176.1 |
| 3,760,659 | 9/1973 | Campbell | 81/176.15 |
| 3,868,874 | 3/1975 | Olashaw | 81/121.1 |
| 3,869,945 | 3/1975 | Zerver . | |
| 4,631,989 | 12/1986 | Trowbridge et al. . | |
| 4,905,547 | 3/1990 | Nigrelli | 81/176.15 |
| 4,979,355 | 12/1990 | Ulevich | 81/185 |
| 5,101,695 | 4/1992 | Johnson . | |
| 5,214,985 | 6/1993 | Rinehart . | |
| 5,396,819 | 3/1995 | Bradley . | |
| 5,425,289 | 6/1995 | Iwinski | 81/3.4 |
| 5,542,321 | 8/1996 | Fuca | 81/125.1 |
| 5,566,595 | 10/1996 | Goff . | |
| 5,697,268 | 12/1997 | Makovsky et al. | 81/125 |

*Primary Examiner*—David A. Scherbel
*Assistant Examiner*—Philip J. Hoffmann
*Attorney, Agent, or Firm*—William Patrick Waters

[57] ABSTRACT

A wrench for engaging a faucet mounting nut, the wrench including an elongated tubular pipe which has slots at one end. A nut engaging socket, having radially projecting studs, is adapted for reversible insertion into the pipe opening, with the socket studs engaging the slots in the pipe. A variety of socket inserts, for engagement of a variety of nut sizes and shapes, is provided. Openings in the pipe, at the end opposite the socket engaging end, provide a means for a rod to be inserted into the pipe to facilitate pipe rotation. The elongated pipe, since it is hollow, can slide over a water supply line during mounting nut removal, thereby eliminating the requirement of first detaching the supply line.

14 Claims, 1 Drawing Sheet

SINK WRENCH

FIELD OF THE INVENTION

The present invention relates generally to wrenches and, more particularly to methods and devices for installing or removing nuts in hard to reach places.

BACKGROUND OF THE INVENTION

The sinks in kitchens and bathrooms of residences and commercial buildings are mounted against a wall. Usually, the sink has a shelf, interposed between the sink basin and the wall, on which a faucet is mounted. In many cases, the faucet is fixed in place by a pair of elongated tubular threaded bolts which extend through the shelf and an underlining counter and are secured by nuts under the counter. The nuts are often hexagonal in shape although in some cases, wing nuts are used. In addition to their role in securing the faucet to the sink, the elongated bolts are threaded to accept a second nut which attaches the water supply line to the faucet.

During faucet installation, it is necessary for one to reach up into the confined space, between the sink basin and the wall, to tighten the nuts on the elongated bolt. This is often a very difficult task since conventional wrenches are not usable in the confined space.

During faucet removal, a similar problem exists because now the nuts must be removed and the problem of removing the nuts is often more severe because of corrosion which tends to freeze the nut in place. The problem can be exacerbated if the nut securing the water supply line proves difficult to dislodge.

In view of the foregoing, it would be very desirable to have a wrench which could effectively and efficiently engage a variety of faucet mounting nuts in confined spaces. Ideally, such a wrench would be convenient to use and would be inexpensive to manufacture.

DISCLOSURE OF THE INVENTION

It is an object of the present invention to provide a wrench that can be used conveniently for installation or removal of under sink faucet mounting nuts.

It is another object of the present invention to provide a wrench engaging nuts which have differing sizes and shapes.

It is a further object of the present invention to provide a wrench that requires relatively few parts and is inexpensive to manufacture.

Briefly, the above and further objects of the present invention are realized by providing a wrench for engaging a faucet mounting nut, the wrench including an elongated tubular pipe which has slots at one end. A nut engaging socket, having radially projecting studs, is adapted for reversible insertion into the pipe opening, with the socket studs engaging the slots in the pipe. A variety of socket inserts, for engagement of a variety of nut sizes and shapes, is provided. Openings in the pipe, at the end opposite the socket engaging end, provide a means for a rod to be inserted into the pipe to facilitate pipe rotation. The elongated pipe, since it is hollow, can slide over a water supply line during mounting nut removal, thereby eliminating the requirement of first detaching the supply line.

The present invention affords several advantages. A principal advantage of the invention is the fact that the elongated pipe can be readily utilized in cramped spaces for reaching sink mounting nuts. In addition, the insertable sockets provide a capability of using the invention with a variety of differing nut shapes and sizes. Further, the invention makes it possible to remove mounting nuts without the necessity of first removing the water supply line since the elongated pipe conveniently slides over the supply line. Still further, the invention is comprised of few parts and is constructed of readily available and inexpensive materials.

BRIEF DESCRIPTION OF THE DRAWINGS

The above mentioned and other objects and features of this invention and the manner of attaining them will become apparent and the invention itself will be best understood by reference to the following description of the embodiment of the invention in conjunction with the accompanying drawings, wherein.

BEST MODE FOR CARRYING OUT THE INVENTION

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

Figure 1:
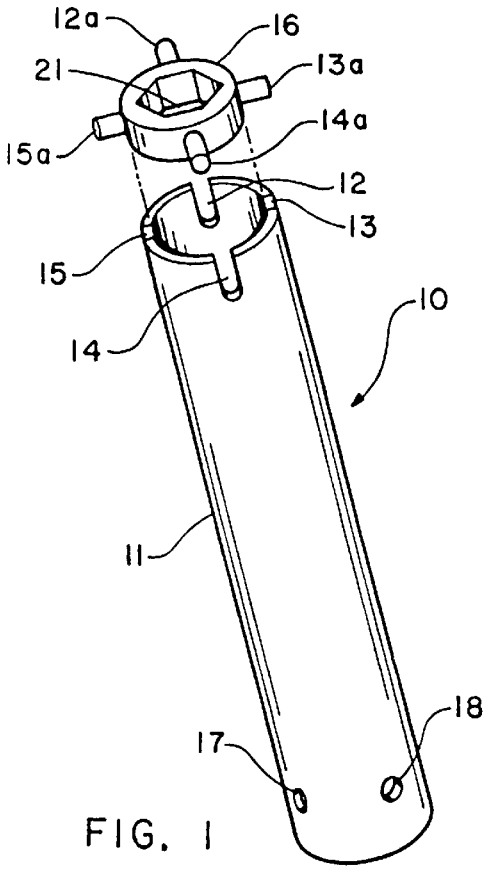
FIG. 1 is an isometric view of a wrench according to the present invention.
Figure 4:
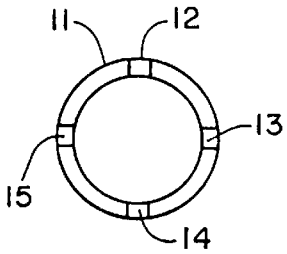
FIG. 4 is a cross sectional view of the wrench shown in FIG. 1.

An embodiment of the present invention is disclosed as a wrench 10, as best shown in FIG. 1. The wrench 10 comprises a cylindrical pipe 11, having slots 12–15 at one end. The slots are disposed, one per quadrant, along the edge of the pipe 11, as shown in FIG. 4.

Figure 6:
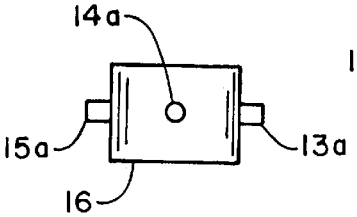
FIG. 6 is a side elevational view of the socket insert shown in FIG. 5.
Figure 5:
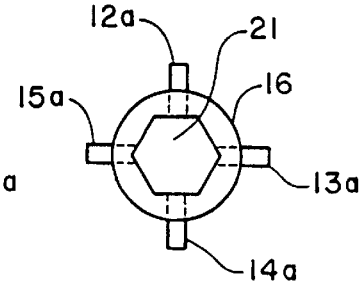
FIG. 5 is a plan view of the socket insert shown in FIG. 1.

A solid cylindrical socket 16, having an outside diameter slightly less than the inside diameter of the pipe 11, is provided for insertion into the pipe 11. The socket 16 has radially outwardly projecting studs 12*a*–15*a* (FIGS. 5 and 6) which fit, respectively, into the slots 12–15 when the socket 16 is inserted in the pipe 11. It will be noted that the engagement of the studs with the slots serves to hold the socket 16 in place during rotational movement of the wrench 10. The socket 16 includes a centrally disposed hexagonally shaped opening 21 for engaging a similarly shaped faucet mounting nut (not shown).

Near the end of the pipe 11, opposite the slots 12–15, the pipe 11 includes a plurality of openings, such as the openings 17 and 18. During use of the wrench 10, after the mounting nut has been engaged by the socket 16, for installation or removal, a rod, such as a Phillips screwdriver, may be inserted through the opening 18, and out through a similar opening (not shown) on the opposite side of the pipe 11. Use of the rod in this manner provides leverage for rotational movement of the pipe 11.

Figure 2:
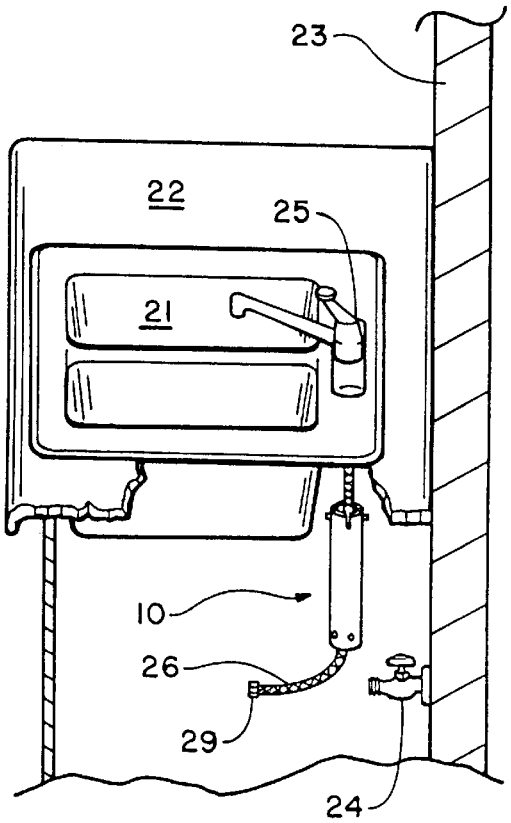
FIG. 2 is an elevational view of a sink shown installed on a counter, a portion of the counter being cut away.

The operation of the wrench 10 in removing a faucet mounting nut (not shown) is clearly understood by reference to FIG. 2. Use of the wrench 10 in mounting nut removal is described although it will be apparent that the technique is relevant also to a mounting nut installation method.

In FIG. 2, there is shown a sink 21 installed in a counter 22 which abuts a structural wall 23. A faucet 25 is held in place on the counter 22 by a pair of mounting nuts (not shown) which engage threaded pipes (not shown), under the counter 22, for the hot and cold water sides of the faucet. Typically the nuts are hexagonal in shape although other shaped nuts, including wing nuts, are sometimes used.

A water supply line 26 is interposed between a stopcock 24 and the faucet 25 and can be connected to the stopcock 24 by a nut 29. At the opposite end (not shown) of the water supply line 26, another nut is used to attach the water supply line 26 to one of the threaded pipes.

By using prior art techniques, it is very difficult to use a wrench for removal of the mounting nuts. The space available for purchase on the mounting nut, and movement of the tool, are very limited because of the confined quarters. Difficulty of nut removal is compounded because, after a faucet has been in place for some time, corrosion formed around the mounting nut makes its removal very difficult.

Prior art techniques for mounting nut removal are further limited because they generally require removal of the water supply line 26 before the mounting nut can be accessed for removal.

Many of the limitations of prior art devices and mounting nut removal techniques are eliminated by the wrench 10. In a typical case, an appropriate socket, such as the socket 16, is inserted into the pipe 11. The nut 29 is separated from the stopcock 24 and the wrench 10 is coaxially moved over the water supply line 29. In this manner, the wrench 10 is moved upward until the socket 16 engages the mounting nut. At this point, if rotation by hand of the wrench 10 is not effective, a rod or a screwdriver can be inserted through the opening 17 or 18 in order to provide rotational leverage.

Thus, the mounting nut, which has an opening having a larger internal diameter than the outside diameter of the nut joining the water supply line 27 to the threaded pipe, is unscrewed from the threaded pipe to permit removal of the faucet 25 from the sink 21.

Figure 3:
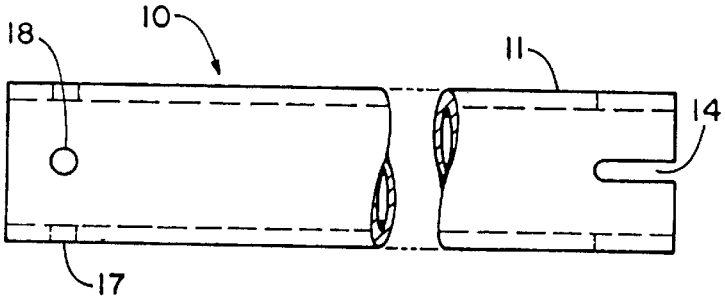
FIG. 3 is a side view of the wrench of FIG. 1, shown in indeterminate length.

As indicated in FIG. 3, the wrench 10 includes a tubular pipe 11 of indeterminate length. In practice, a length between six and twelve inches is suitable with a preferred length being about eight inches. The pipe 11 may be constructed of a variety of appropriate materials while 1¼ inch P.V.C. schedule 40 pipe is preferred.

Figure 7:
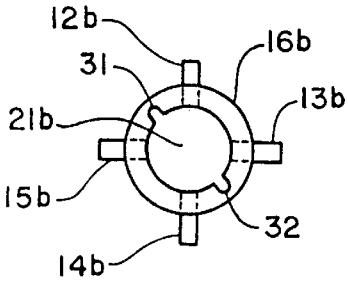
FIG. 7 is a plan view of another socket insert.

With reference now to FIG. 7, there is shown another socket 16*b* which is identical in function to that of the socket 16. The socket 16*b* is utilized when the faucet mounting nut is a wing nut. The socket 16*b* is a solid cylinder having radially outwardly projecting studs 12*b*–15*b*. As in the case of socket 16, the studs 12*b*–15*b* engage the slots 12–15, respectively, in the pipe 11. The socket 16*b* includes a centrally located opening 21 having opposing slots 31 and 32 for engaging the wings of a wing nut.

The sockets 16 and 16*b* may be constructed of a variety of metal or plastic materials. In a preferred embodiment, the sockets are constructed of molded steel and the studs 12*a*–15*a* and 12*b*–15*b* are rolled steel.

It will be apparent to one skilled in this art that while sockets for hexangonally shaped nuts and wing nuts have been described, sockets similar in design for engaging other shapes of nuts are within the scope of this disclosure.

Thus, it will be evident that there are additional embodiments and applications which are not disclosed in the detailed description but which clearly fall within the scope and spirit of the present invention. The specification is, therefore, intended not to be limiting, and the scope of the invention is to be limited only by the following claims.

What is claimed is:

1. A wrench, adapted for engaging a faucet mounting nut, the wrench comprising:

an elongated pipe, said pipe including a plurality of slots at a first end thereof; and a nut engaging socket adapted for reversible insertion into said pipe at said first end, said socket including a plurality of studs wherein said studs fit into said slots for helping to secure said socket within said elongated pipe.

2. A wrench according to claim 1 wherein said socket is a solid cylindrical body, said body having a diameter less than the inside diameter of said elongated tubular pipe.

3. A wrench according to claim 1 wherein said socket is a solid cylindrical body and said studs project radially outwardly therefrom.

4. A wrench according to claim 1 wherein said socket is a solid cylindrical body having a nut engaging opening centrally disposed therein.

5. A wrench according to claim 1 wherein said socket is a solid cylindrical body having a hexagonally shaped opening centrally disposed therein.

6. A wrench according to claim 1 wherein said socket is a solid cylindrical body having a wing nut receiving opening centrally disposed therein.

7. A wrench according to claim 1 wherein said elongated pipe includes an opening for receiving a tool for rotating said pipe.

8. A wrench, adapted for engaging a faucet mounting nut, the wrench comprising:

an elongated pipe, said pipe including a plurality of slots at a first end thereof; and a nut engaging socket adapted for reversible insertion into said pipe at said first end, said socket including a plurality of studs wherein said studs fit into said slots for helping to secure said socket within said elongated pipe, wherein said socket is a solid cylindrical body, said body having a diameter less than the inside diameter of said elongated tubular pipe and said plurality of studs project radially outwardly from said body.

9. The wrench according to claim 8, wherein said socket is a solid cylindrical body, said body having a diameter less than the inside diameter of said elongated pipe.

10. The wrench according to claim 8, and said studs project radially outwardly therefrom.

11. The wrench according to claim 8, wherein said socket is a solid cylindrical body having a nut engaging opening centrally disposed therein.

12. The wrench according to claim 8, wherein said socket is a solid cylindrical body having a hexagonally shaped opening centrally disposed therein.

13. The wrench according to claim 8, wherein said socket is a solid cylindrical body having a wing nut receiving opening centrally disposed therein.

14. The wrench according to claim 8, wherein said elongated pipe includes an opening for receiving a tool for rotating said pipe.

* * * * *